United States Patent [19]

Voegeli

[11] Patent Number: 4,582,190

[45] Date of Patent: Apr. 15, 1986

[54] SELF-CONTAINED MODULE FOR CONTROLLING ACCESS TO A DISPLAY MACHINE

[76] Inventor: Ronald C. Voegeli, 918 Gibbs Rd., Venice, Fla. 33595

[21] Appl. No.: 696,337

[22] Filed: Jan. 30, 1985

[51] Int. Cl.[4] ..... G07F 11/04

[52] U.S. Cl. ..... 194/248; 194/350; 49/380; 312/292

[58] Field of Search ..... 194/1 A, 1 G, 1 L, 51, 194/54, 59, 65; 49/380, 35; 312/138 R, 138 A, 139, 292; 248/27.1

[56] References Cited

U.S. PATENT DOCUMENTS

| | | | |
|---|---|---|---|
| 3,253,690 | 5/1966 | Brewton et al. | 194/54 |
| 3,870,136 | 3/1975 | Voegeli | 194/54 |
| 4,371,072 | 2/1983 | Voegeli | 194/54 |
| 4,386,691 | 6/1983 | Voegeli | 194/7 |
| 4,509,631 | 4/1985 | Kim | 194/1 A |

*Primary Examiner*—Joseph J. Rolla
*Assistant Examiner*—Jay I. Alexander
*Attorney, Agent, or Firm*—Burns, Doane, Swecker & Mathis

[57] ABSTRACT

A newspaper display machine comprises a base frame forming therein an interior compartment, and an access opening communicating with the compartment. A self-contained module is provided for controlling the access to the compartment. The self-contained module comprises a casing which is securable to the base frame, a door pivotably carried by the casing, and a coin-actuated mechanism for enabling the door to be opened.

6 Claims, 8 Drawing Figures

14
32
12
30
36
31
59
50
62
52
54
56
38
26
16
22

SELF-CONTAINED MODULE FOR CONTROLLING ACCESS TO A DISPLAY MACHINE

BACKGROUND AND OBJECTS OF THE INVENTION

The present invention relates to display machines and, in particular, to newspaper display machines.

Newspaper display machines typically comprise a base frame forming an interior compartment for containing newspapers, and an accessing mechanism for controlling the access to the compartment. The accessing mechanism typically comprises an access door and a coin-actuated unlocking mechanism which enables the door to be opened so that newspapers can be removed from the compartment. The components of the accessing mechanism are often designed in accordance with the configuration of the particular base frame in which they are to be installed. Thus, if the frame configuration is changed, or if it is desired to employ the mechanical components in other types of frames other than that for which the components were initially designed, it is possible that some or all of the components of the accessing mechanism must also be redesigned. In addition, the accessing mechanism is normally marketed as being attached to a base frame. Thus, a purchaser who wishes to build-in his own type of base must still purchase a base frame from the manufacturer and then disassemble the accessing mechanism therefrom before installing the latter in his own base frame.

It is, therefore, an object of the present invention to minimize or obviate shortcomings of the type discussed above.

Another object is to provide a novel display machine in which the components of the accessing mechanism are not restricted to use solely with particular base frame configurations.

A further object is to provide a module adapted to be installed in one-piece onto a base frame of a display machine, which module contains all of the basic components of the accessing mechanism.

An additional object is to minimize the time and effort needed to assemble a display machine.

SUMMARY OF THE INVENTION

These objects are achieved by the present invention which relates to a display machine for items such as newspapers and the like. The display machine comprises a base frame forming therein an interior compartment for containing items to be sold, and an access opening communicating with the compartment. A self-contained module is provided for controlling the access to the compartment. The module comprises a casing including a wall structure insertable through the access opening, and flanges secured to the base frame. The door is pivotably carried by the wall structure and includes a transparent window, a gripping handle, a securing bracket, and a spring biasing the door to a closed position. The wall structure supports a coin-actuated unlocking mechanism which includes a stop for securing the bracket against opening, and means for releasing the bracket to enable the door to be opened.

The present invention also contemplates the self-contained module itself which is suitable for use with a base frame of a display machine.

THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figure 2:
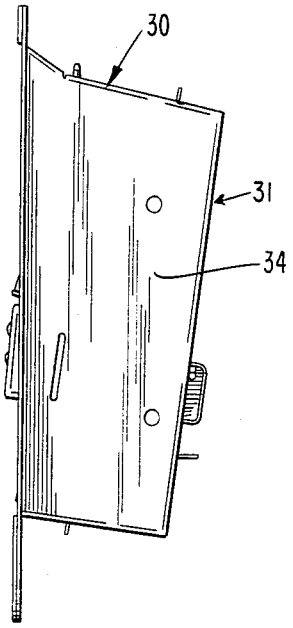
FIG. 2 is a side elvational view of the self-contained module, depicting a side thereof opposite the side depicted in FIG. 1.
Figure 1:
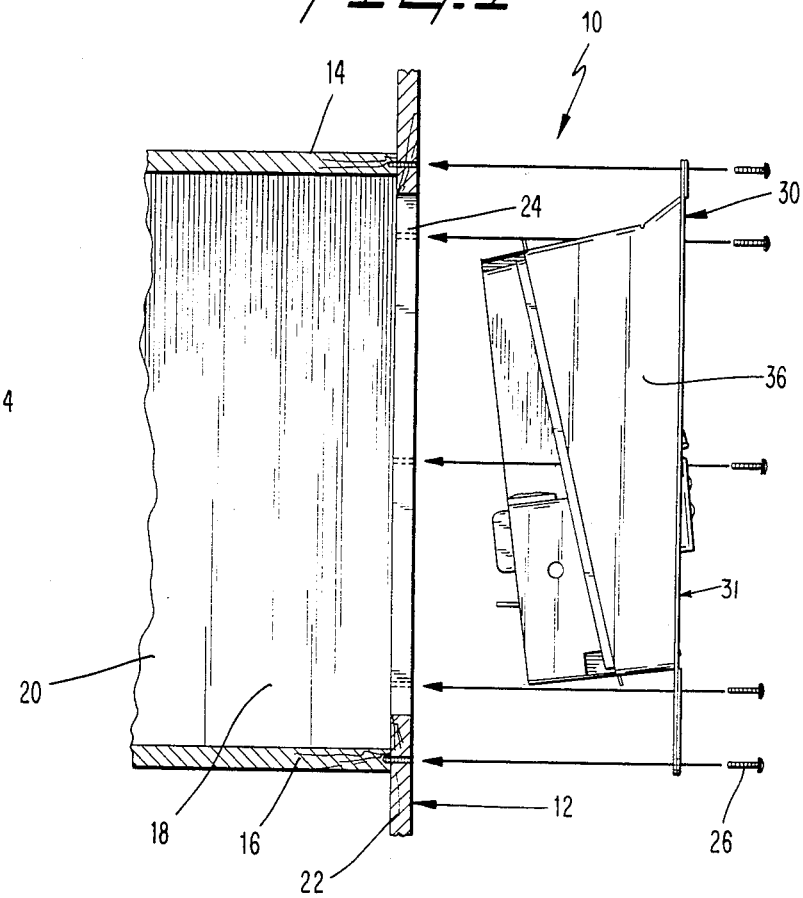
FIG. 1 is a side exploded view of a base frame and self-contained module of the present invention.
Figure 3:
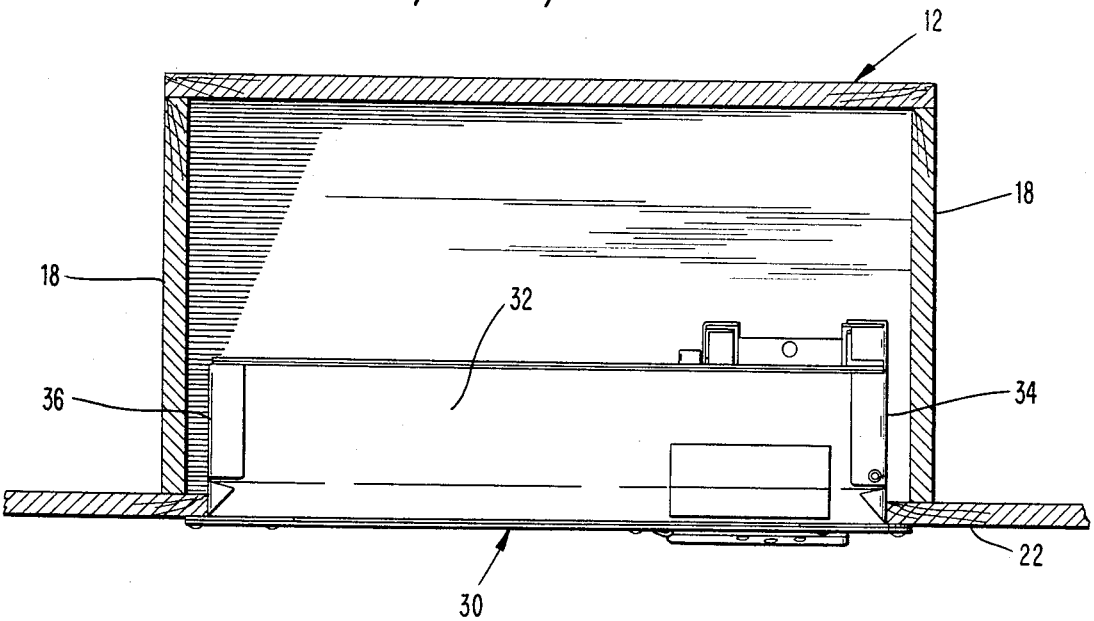
FIG. 3 is a horizontal sectional view taken through the base frame to depict the module in top plan view.

In FIG. 1 there is depicted a portion of a display machine 10 such as a newspaper display machine. The display machine 10 comprises a base frame 12 which includes top, bottom and side walls 14, 16, 18 forming therewithin an interior compartment 20 for containing newspapers to be displayed. Mounted across the front of the compartment is a front plate 22 which includes an access opening 24. The front plate 22 can be secured to the walls 14, 16, 18 by suitable fasteners such as screws 26. The walls 14, 16, 18 and front plate 22 can be formed of any suitable material such as metal or wood, for example. The base frame 12 includes a suitable ground support portion or pedestal (not shown).

Mounted to the base frame 12 is a module 30 which includes the basic components of an accessing mechanism which controls the access to the interior compartment. The module 30 can be attached to, or removed from the base frame 12 as one unitary piece.

Figure 4:
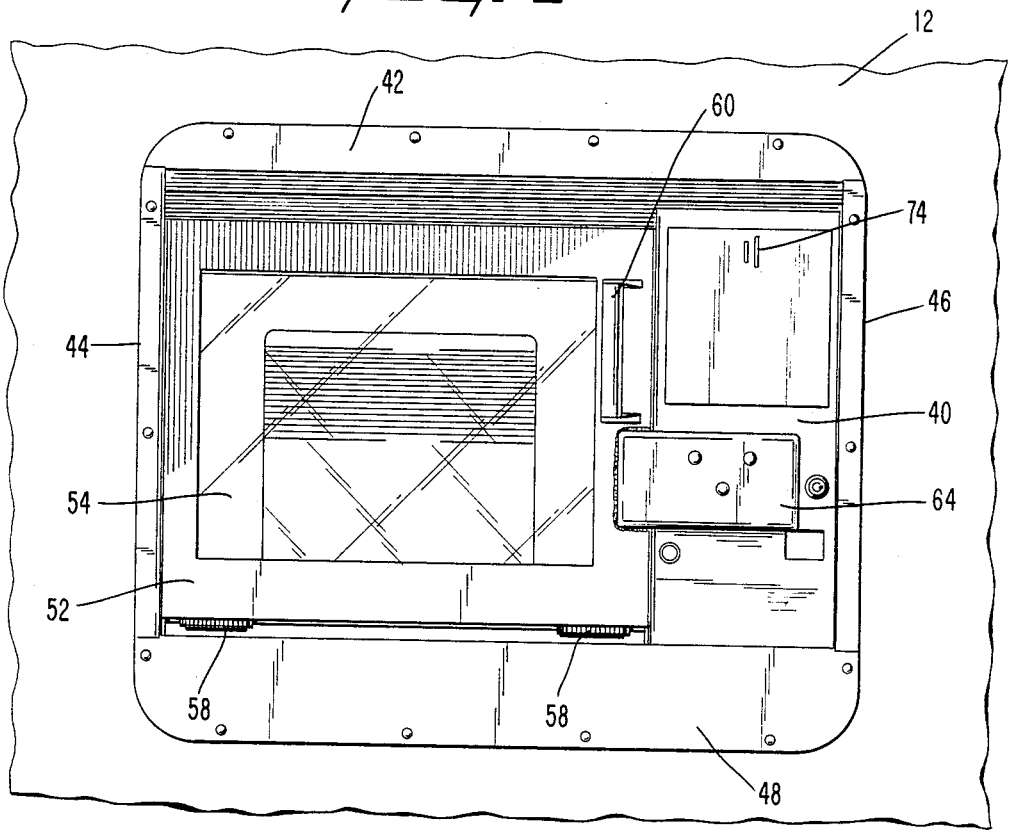
FIG. 4 is a front elevational view of the self-contained module when the door thereof is in the closed condition.
Figure 6:
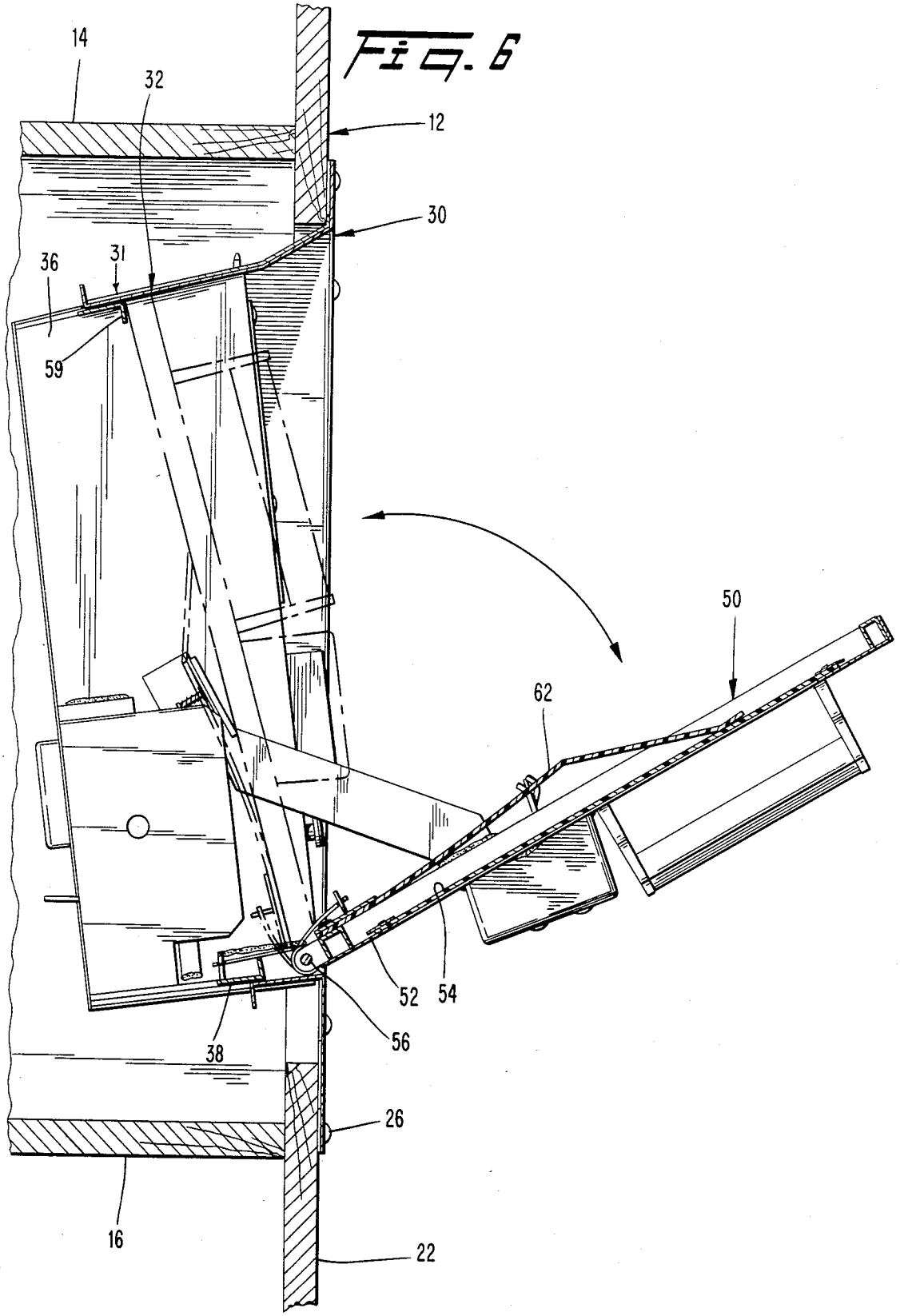
FIG. 6 is a vertical sectional view taken along the line 6—6 of FIG. 5, depicting the door in a opened position in solid lines, and in a closed position in broken lines.

The module comprises a casing 31 which includes an upper wall 32 (see FIG. 6), first and second side walls 34, 36, a lower wall 38, a front wall 40 (see FIG. 4), and laterally outwardly projecting mounting flanges 42, 44, 46, 48 at the front of the casing, which flanges are securable to the base frame 12 by means of the fasteners 26. The afore-mentioned walls 32–40 and flanges 42–48 may be formed of any suitable material, such as metal, and integrally attached together such as by welding.

Swingably mounted to the casing 30 is an access door 50. The door 50 is similar to that described in the present inventor's application Ser. No. 06/530,788 filed Sept. 9, 1983, now U.S. Pat. No. 4,544,081, the disclosure of which is hereby incorporated by reference herein. The door 50 includes a rigid plate 52 which has a transparent window 54. The plate 52 is pivotably mounted to the casing 12 by means of a pivot rod 56 (FIG. 6) which is carried by the side walls 34, 36 of the casing 31 and is received in aligned holes formed at the bottom of the plate 52. Suitable torsion springs 58 (FIG.

4) bias the door 50 to a closed position, wherein it abuts a rectangular stop flange 59 (FIG. 5) mounted on the casing. A handle 60 is mounted on the plate 52 to enable a user to pull the door 50 open.

The door 50 carries a transparent pressure plate 62, e.g., transparent plastic, which is secured along its bottom edge 52 to the rigid plate 52. In practice, a folded display newspaper (not shown) can be inserted between the pressure plate 62 and the window 54, with the pressure plate 62 retaining such newspaper in place.

Figure 5:
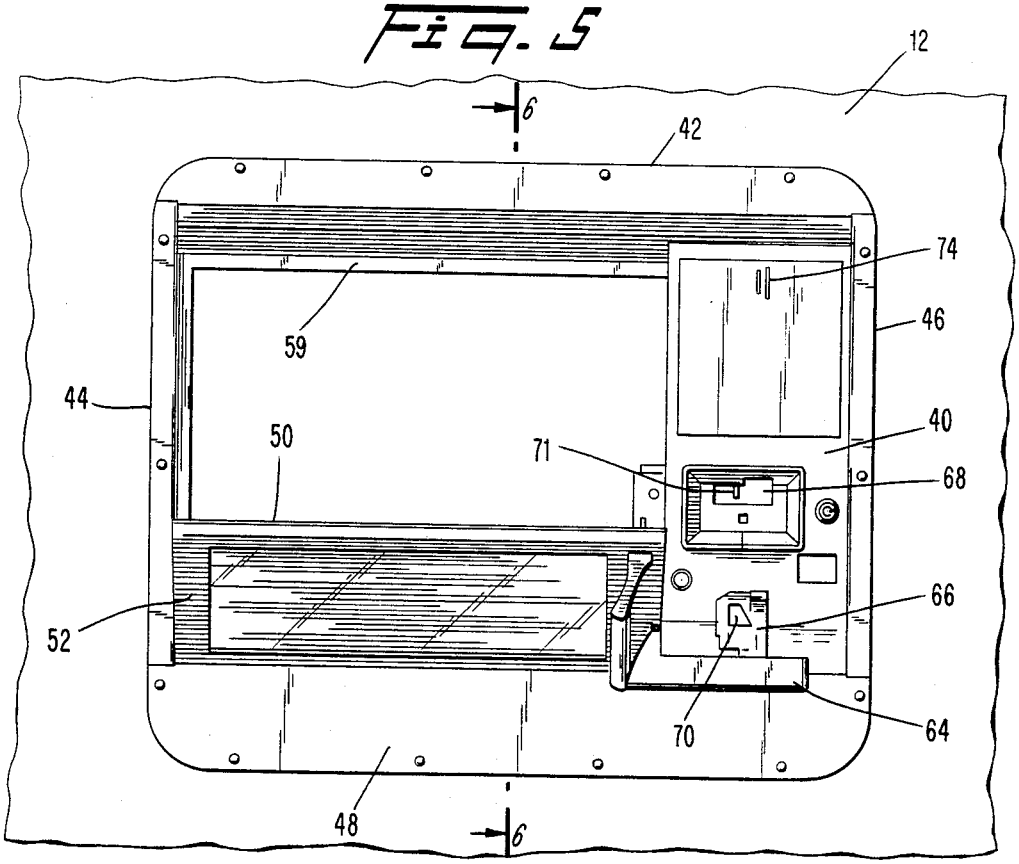
FIG. 5 is a view similar to FIG. 4, with the door of the module in the opened condition.
Figure 7:
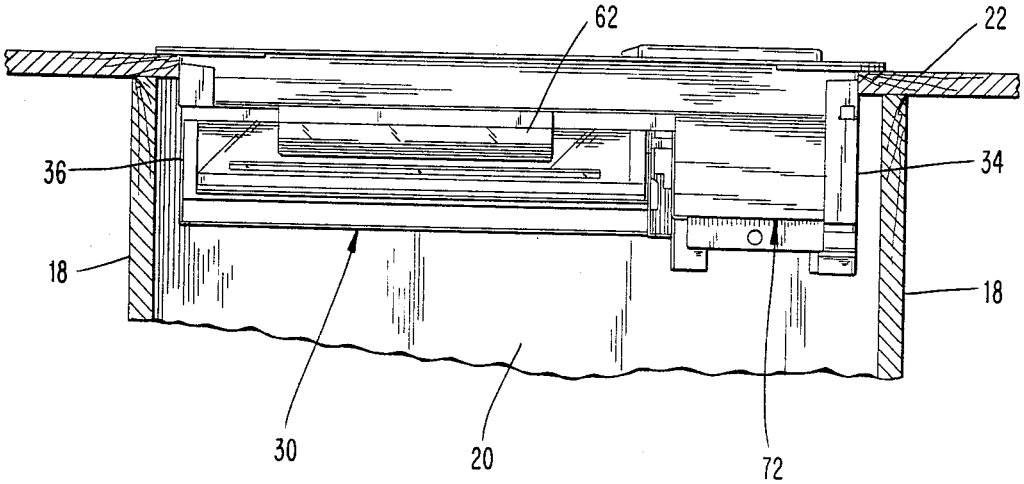
FIG. 7 is a horizontal sectional view through a base frame, depicting the self-contained module in bottom plan view.
Figure 8:
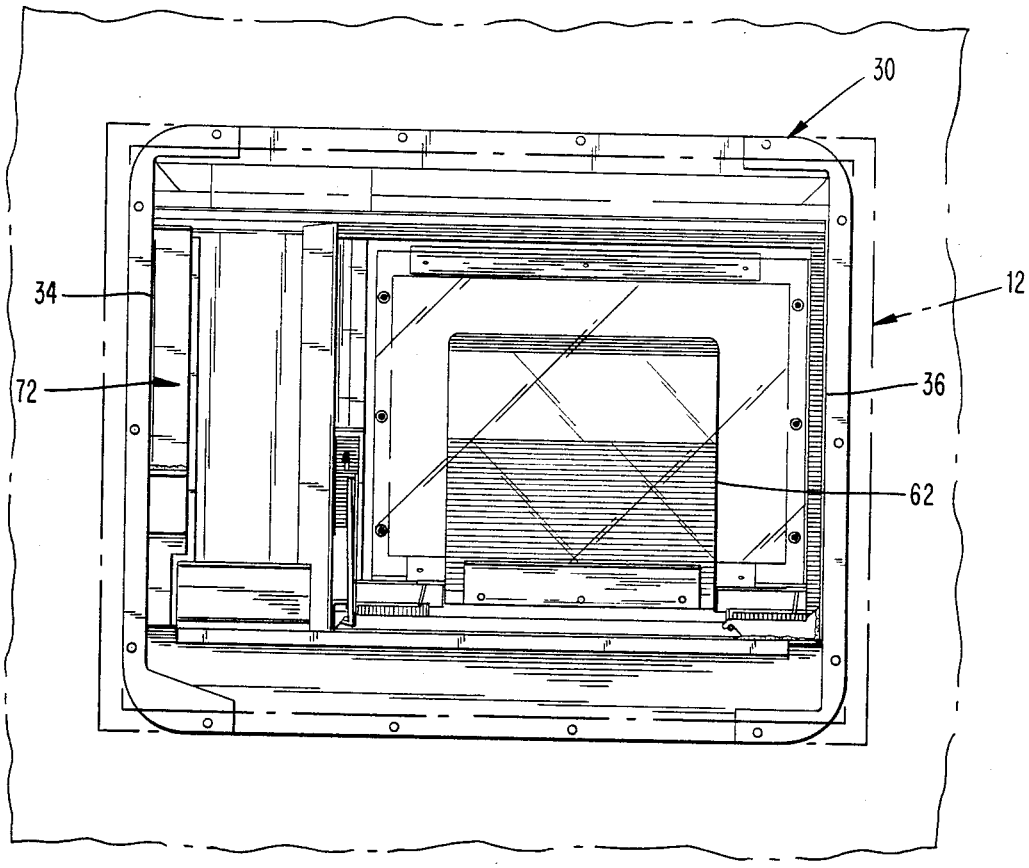
FIG. 8 is a rear elevational view of the self-contained module.

Projecting laterally outwardly from the rigid plate 52 is a flange 64 (FIG. 4) which pivotably carries a securing bracket 66 (FIG. 5). The securing bracket 66 is arranged to enter a slot 68 in the front wall 40 of the casing 31 when the door 50 is in a closed condition. The bracket 66 includes a hole 70 (FIG. 5) which receives a suitable stop finger 71 to secure the door 50 in a closed condition. The stop finger 71 forms part of a coin-operated unlatching mechanism 72 (FIGS. 7, 8) the details of which do not form an essential part of the present invention. Any suitable unlatching mechanism can be employed, such as those disclosed in the present inventor's U.S. Pat. Nos. 3,870,136; 4,371,072; and 4,386,691, the disclosures of which are hereby incorporated by reference herein.

The unlatching mechanism 72 is mounted on the casing 31. In operation, when the bracket 66 enters the slot 68, the finger 71 enters the hole 72 to prevent the door from being reopened. If the proper coinage is deposited into the unlatching mechanism 70 through slits 74 formed in the front wall 40 of the casing 31, the bracket 66 is cammed downwardly to disengage the finger from the hole, allowing the bracket to pass beneath the finger 71 when an outward force is applied to the door 50.

It will be appreciated that the module 30, which carriers all of the components controlling the access to the interior compartment 20, can be fully assembled separately of the base frame 12, and then inserted therein as a fully self-contained, operable module, as depicted in FIG. 1. Once the screws 26 are installed, the assembly of the module to the base frame is complete. Accordingly, it is unnecessary to redesign the access-controlling mechanism for use with a different base frame. Rather, it is merely necessary to provide an access opening 24 in the base frame large enough to receive the upper, lower, and side walls 32, 34, 36 of the casing 31, but not the mounting flanges 42–48. Those flanges can be of any suitable size and shape to be adaptable to a wide range of base frame configurations. Furthermore, the module can be sold separately from a base frame, whereby the customer can install it into his own type of base frame.

Although the present invention has been described in connection with a preferred embodiment thereof, it will be appreciated by those skilled in the art that additions, modifications, substitutions, and deletions may be made without departing from the spirit and scope of the invention as defined in the appended claims.

What is claimed is:

1. A display machine for items such as newspapers and the like, comprising:

a base frame forming therein an interior compartment for containing items to be sold, and an access opening communicating with said compartment, a self-contained module for controlling the access to the compartment, comprising:

a casing including wall means insertable through said access opening, and flange means secured to said base frame, a door pivotably carried by said wall means of said casing and including a transparent window, a gripping handle, a securing bracket, and spring means biasing said door to a closed position, and said wall means including means for supporting a coin-actuated unlatching mechanism including a stop for securing said bracket against opening, and means for releasing said bracket to enable said door to be opened.

2. A display machine according to claim 1, wherein said flange means projects laterally beyond said access opening.

3. A display machine according to claim 1, wherein said wall means of said module comprises an upper wall, a lower wall, first and second side walls, and a front wall, said upper wall, lower wall and side walls projecting through said access opening of said base frame.

4. A display machine according to claim 1 including fasteners securing said flange means to said base frame.

5. A self-contained module for use with a base frame of a display machine, to control access to an interior compartment of said base frame, said self-contained module comprising:

a casing including wall means and mounting flange means disposed at a front of said wall means, a door pivotably carried by said wall means of said casing and including a transparent window, a gripping handle, a securing bracket, and spring means for biasing said door to a closed position, and said wall means including means for supporting a coin-actuated unlatching mechanism including a stop for securing said bracket against said opening, and means for releasing said bracket to enable said door to be opened.

6. A self-contained module according to claim 5, wherein said flange means projects laterally outwardly at said front of said wall means.

* * * * *